US009499329B2

(12) United States Patent
Ogata et al.

(10) Patent No.: US 9,499,329 B2
(45) Date of Patent: Nov. 22, 2016

(54) AEROSOL CONTAINER NOZZLE AND AEROSOL CONTAINER DISPENSER

(71) Applicant: TOYO AEROSOL INDUSTRY CO., LTD., Tokyo (JP)

(72) Inventors: Ken Ogata, Tokyo (JP); Hirokazu Shimizu, Tokyo (JP); Toru Toma, Tokyo (JP); Kotaro Fujiwara, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/949,945

(22) Filed: Nov. 24, 2015

(65) Prior Publication Data

US 2016/0083171 A1 Mar. 24, 2016

Related U.S. Application Data

(63) Continuation of application No. PCT/JP2014/063537, filed on May 22, 2014.

(30) Foreign Application Priority Data

May 31, 2013 (JP) ..... 2013-116441

(51) Int. Cl.
*B67D 1/08* (2006.01)
*B65D 83/34* (2006.01)
(Continued)

(52) U.S. Cl.
CPC ..... *B65D 83/34* (2013.01); *B65D 83/206* (2013.01); *B65D 83/22* (2013.01); *B65D 83/28* (2013.01); *B65D 83/345* (2013.01); *B65D 83/68* (2013.01)

(58) Field of Classification Search
CPC .... B65D 83/34; B65D 83/206; B65D 83/22; B65D 83/345; B65D 83/68; B65D 83/28
USPC ..... 222/149, 402.1–402.25, 150, 151, 94, 222/129, 136–140, 145.2, 145.4, 145.5, 466
See application file for complete search history.

(56) References Cited

U.S. PATENT DOCUMENTS 3,250,474 A 5/1966 McKernan
5,516,045 A * 5/1996 Baudin ..... B05B 1/14 239/337

(Continued)

FOREIGN PATENT DOCUMENTS

JP 7-37986 U 7/1995
JP 2000-109150 A 4/2000

(Continued)

OTHER PUBLICATIONS

International Search Report dated Aug. 26, 2014, issued in counterpart International Application No. PCT/JP2014/063537 (3 pages).

(Continued)

*Primary Examiner* — Lien Ngo
(74) *Attorney, Agent, or Firm* — Westerman, Hattori, Daniels & Adrian, LLP

(57) ABSTRACT

This invention makes it possible to spray liquid content while a cleaning member is mounted to a nozzle main body and remove residual liquid without pulling out the cleaning member from the nozzle main body. A nozzle includes a body 10 that presses down two stems 6 together, and a cleaning member 20 having two ejection ports 1*a* and capable of moving relative to the body 10. The body 10 is removably mounted to the stems 6, the cleaning member 20 is slidably inserted into an ejection-side passage R2 and has two tubular parts 21. Each of the tubular parts 21 forms a space R4 that connects a stem-side passage R1 to an annular cross section passage R3 when the cleaning member 20 is pulled out, while reduces this space R4 to thereby remove a residual material C when the cleaning member 20 is pushed in.

9 Claims, 15 Drawing Sheets

(51) Int. Cl.

| | |
|---|---|
| ***B65D 83/20*** | (2006.01) |
| ***B65D 83/22*** | (2006.01) |
| ***B65D 83/68*** | (2006.01) |
| ***B65D 83/28*** | (2006.01) |

(56) References Cited

U.S. PATENT DOCUMENTS

| | | | | |
|---|---|---|---|---|
| 5,901,883 | A * | 5/1999 | Ritsche | A61M 15/009 222/137 |
| 6,341,717 | B2 * | 1/2002 | Auer | 222/135 |
| 6,672,483 | B1 * | 1/2004 | Roy | B05B 11/0037 222/136 |
| 6,817,493 | B1 * | 11/2004 | Parsons | B05B 1/14 222/330 |
| 7,063,235 | B2 * | 6/2006 | Auer | B05B 11/0064 222/135 |
| 2011/0315712 | A1 * | 12/2011 | Chiba | B05B 11/3001 222/137 |
| 2013/0119088 | A1 | 5/2013 | Hanai et al. | |
| 2013/0175297 | A1 * | 7/2013 | Sugimoto | B65D 83/206 222/135 |

FOREIGN PATENT DOCUMENTS

| | | | |
|---|---|---|---|
| JP | 2002-326676 | A | 11/2002 |
| JP | 2003-020083 | A | 1/2003 |
| JP | 2011-162227 | A | 8/2011 |
| JP | 2012-30886 | A | 2/2012 |

OTHER PUBLICATIONS

Extended (Supplementary) European Search Report (EESR) dated Apr. 28, 2016, issued in counterpart European Patent Application No. 14 80 4018. (2 pages).

* cited by examiner (a)

(b)

(a)

(b)

A-A CROSS SECTION (a)

(b)

(a)

(b)

B-B CROSS SECTION (a)
E-E CROSS SECTION (b)
F-F CROSS SECTION (a)

(b)

AEROSOL CONTAINER NOZZLE AND AEROSOL CONTAINER DISPENSER

TECHNICAL FIELD

The present invention relates to an aerosol container nozzle and an aerosol container dispenser.

BACKGROUND ART

As a conventional aerosol container dispenser, one that has a nozzle body mounted to a plurality of stems, and a cleaning member removably attached to an ejection port of this nozzle body, has been proposed (see, for example, Patent Document 1). According to this aerosol container dispenser, when the cleaning member is left pushed in the nozzle body, the liquid content can be ejected that way, while after the ejection, any residual liquid content can be scraped out by pulling the cleaning member out of the ejection port.

PRIOR ART LITERATURE

Patent Documents

Patent Document 1: Japanese Patent Application Laid-open No. 2012-30886

SUMMARY OF THE INVENTION

Problems to be Solved by the Invention

With the conventional aerosol container dispenser described above, the cleaning member had to be pulled out after the ejection in order to scrape out the liquid content remaining inside the nozzle after the liquid content has been ejected.

An object of the present invention is to provide a novel aerosol container nozzle and aerosol container dispenser, with which the liquid content can be ejected with the cleaning member being attached to the nozzle body, and with which the residual liquid content can be removed and cleaning can be done without the need to pull out the cleaning member from the nozzle body.

Means for Solving the Problems

An aerosol container nozzle of the present invention comprises a nozzle body that has a plurality of passages formed independently of each other corresponding to a plurality of stems of an aerosol container and that presses down the stems together; and a cleaning member having a plurality of ejection ports corresponding to the stems and being movable back and forth directions relative to the nozzle body, the nozzle body being removably mounted to the stems, and the passages each being formed by a stem-side passage that leads to the stem and an ejection-side passage connected to the stem-the passage and extending forward, the nozzle body having center shafts each extending inside each of the ejection-side passages from an abutment surface in the ejection-side passage along the ejection-side passage, the cleaning member having a plurality of tubular parts each slidably inserted into each of the ejection-side passages and forming, between the tubular part and each of the center shafts, an annular cross section passage leading to the ejection port, wherein the tubular parts each form a space that connects the stem-side passage with the annular cross section passage inside the ejection-side passage when the cleaning member is slid forward, and reduce the space when the cleaning member is slid backward.

In the present invention, a retaining mechanism for retaining the cleaning member should preferably be provided between the nozzle body and the cleaning member.

In the present invention, the cleaning member should preferably include a tab. The tab can be coupled to the cleaning member via a hinge that can pivot up and down.

An aerosol container dispenser of the present invention includes the aerosol container nozzle described above, and a cover member mounted to the aerosol container such as to surround the plurality of stems. The cleaning member includes a nozzle lock portion that makes contact with a shelf plate wall provided to the cover member when the cleaning member is slid backward to prevent the nozzle body from being pushed down. In the aerosol container dispenser of the present invention, the cleaning member may include a lever lock portion that makes contact with a lever provided to the cover member when the cleaning member is slid backward to prevent the lever from being pushed down.

Effects of the Invention

According to the present invention, the liquid content can be ejected with the cleaning member being attached to the nozzle body, and the residual liquid content can be removed and cleaning can be done without the need to pull out the cleaning member from the nozzle body.

EXPLANATION OF REFERENCE NUMERALS

Figure 1:
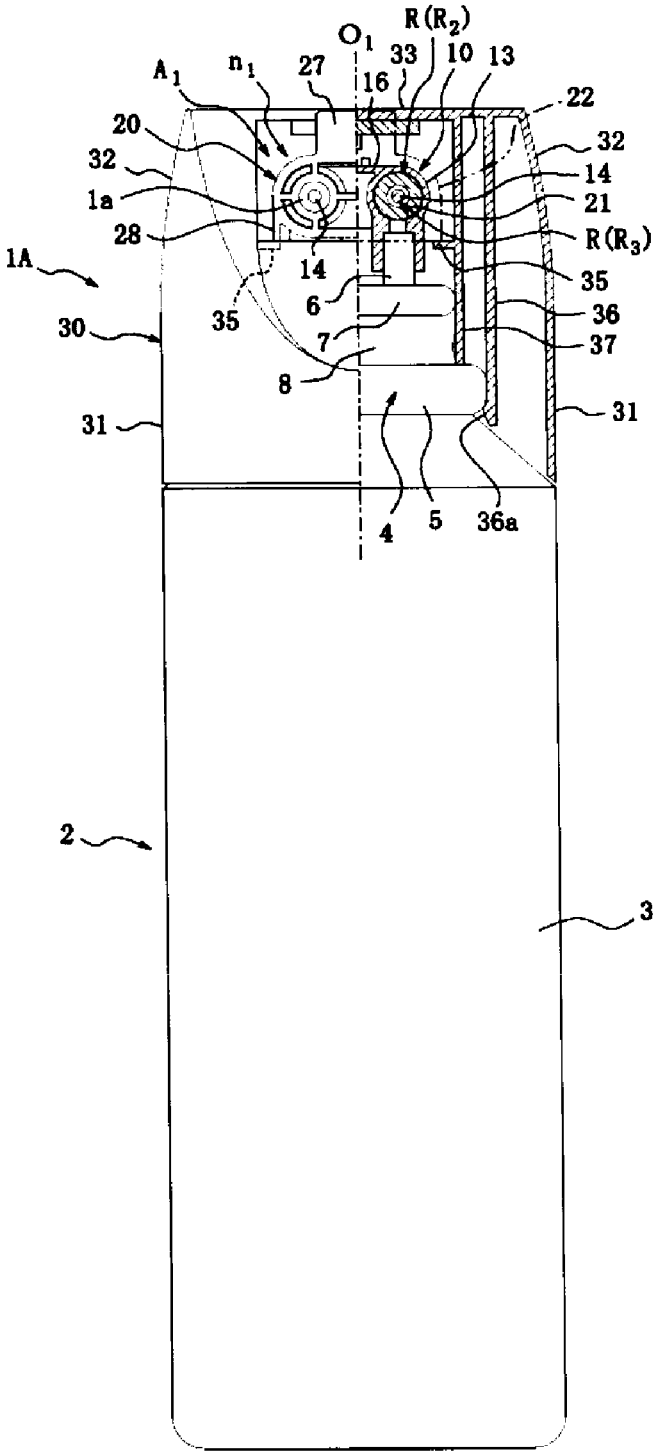
FIG. 1 is a front view of an aerosol container with an aerosol container dispenser having an aerosol container nozzle that is a first embodiment of the present invention, schematically illustrating the dispenser in a half cross section.

1 An aerosol container dispenser
1B: Aerosol container dispenser
1C: Aerosol container dispenser
2: Aerosol container
4: Mounting cup
5: Annular rim
6: Stem
7: Projection
10: Nozzle body
13: Discharge tube
15: Abutment surface
16: Connecting wall
16*s*: Slit (retaining mechanism)
16*e*: Longitudinal abutment edge (retaining mechanism)
14: Center shaft
20: Cleaning member
21: Tubular part
25: Convex section (retaining mechanism)
27: Tab
28: Nozzle lock portion
29: Lever lock portion
30: Cover member
32: Girder portion
32*c*: Top plate
34: Lever
35: Shelf plate wall
38: Positioning wall
40: Fixing plate
48: Positioning wall
50: Pivoting piece
R: Passage
$A_1$: Opening
$B_1$: Through hole
$B_2$: Stem insertion hole
$H_1$: Hinge
$H_2$: Hinge
$H_3$: Hinge
$H_4$: Hinge
$n_1$: Aerosol container nozzle (first embodiment)
$n_2$: Aerosol container nozzle (second embodiment)
$n_3$: Aerosol container nozzle (third embodiment)
$R_1$: Stem-side passage
$R_2$: Ejection-side passage
$R_3$: Annular cross section passage
$R_4$: Space

MODES FOR CARRYING OUT THE INVENTION

Hereinafter, various embodiments of aerosol container nozzles and aerosol container dispensers that are the present invention will be described in detail with reference to the drawings. The "front" in the description below refers to a direction in which an ejection port is oriented, while the "back (rear)" refers to a direction opposite from the "front" along the axial line of a discharge tube provided in a nozzle body. The "upper (above)" refers to a direction in which a stem in the aerosol container is oriented, while the "lower (below)" refers to a direction opposite from the "upper (above)" along the center axial line $O_1$ of the aerosol container.

In FIG. 1, reference numeral 1A denotes an aerosol container dispenser having an aerosol container nozzle, which is a first embodiment of the present invention. This embodiment will be described with reference to FIG. 1 to FIG. 8.

Reference numeral 2 denotes an aerosol container, to which the aerosol container dispenser (hereinafter referred to simply as "dispenser") 1A having the aerosol container nozzle $n_1$ (hereinafter referred to simply as "nozzle") is mounted. The aerosol container 2 is formed by fixedly attaching a mounting cup 4 made of metal, for example, to a bottomed cylindrical container body 3 made of metal, for example, by crimping the outer edge of the cup (the crimped portion forming an annular rim 5). The aerosol container 2 contains two types of contents separately inside. The aerosol container 2 includes a total of two stems 6 that each lead to housing spaces of respective contents. In this embodiment, a projection 7 having an outer shape in the form of a track when viewed from above (shape formed by connecting both ends of two semicircles with straight lines) protrudes from a seat 8 in the center of the mounting cup 4, and the two stems 6 together protrude from this projection 7. The outer shape of the projection 7 when viewed from above may be rectangular or elliptical. In this embodiment, the outer shape of the seat 8 when viewed from above is a true circle.

The nozzle $n_1$ has a nozzle body 10 and a cleaning member 20, while the aerosol container dispenser 1A has the nozzle $n_1$ and a cover member 30.

Figure 5:
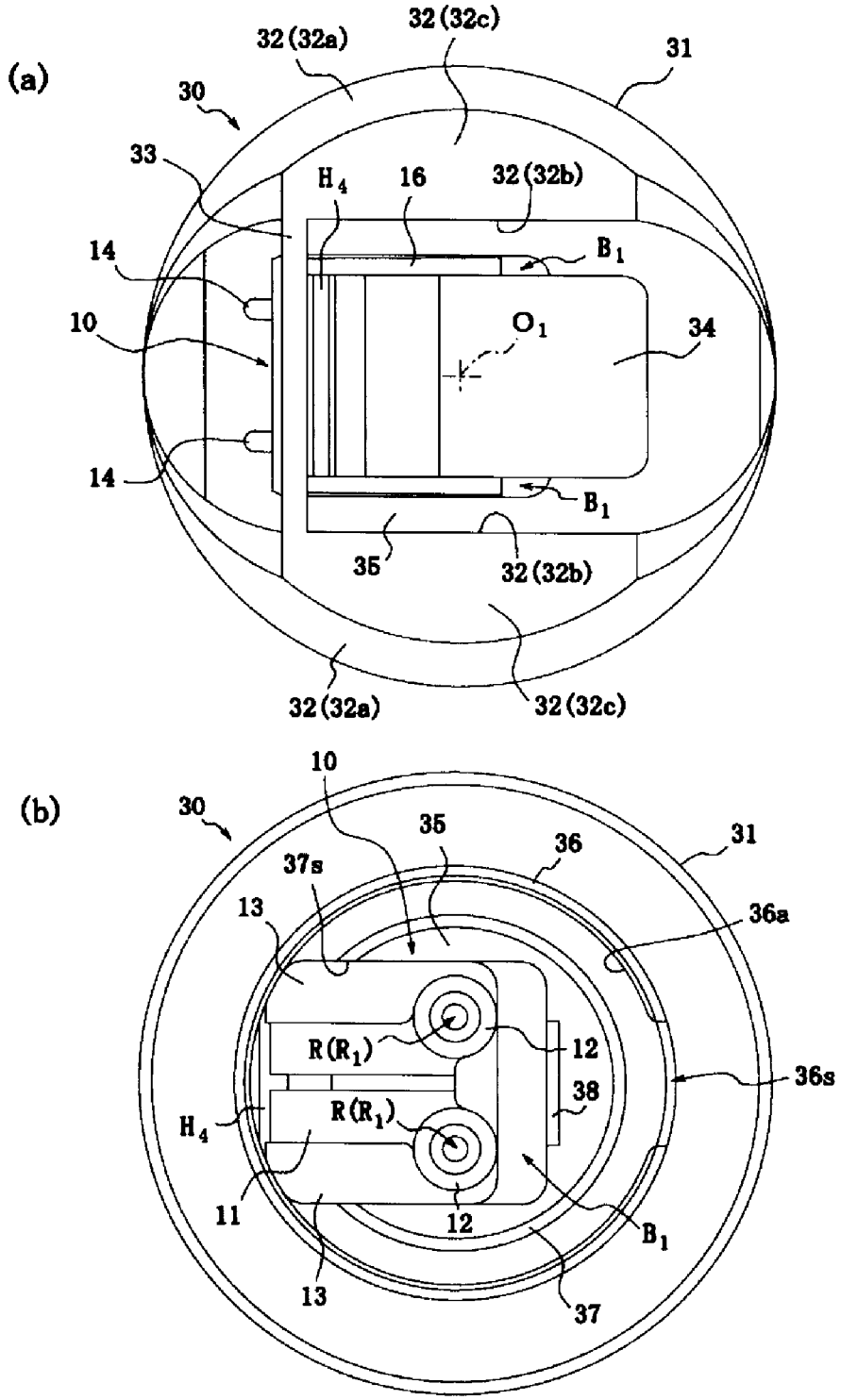
FIG. 5 illustrates a cover member having the nozzle body associated with the aerosol container dispenser shown in FIG. 1, (a) being a top plan view that schematically illustrates the cover member, and (b) being a bottom plan view that schematically illustrates the cover member.

The cover member 30 is mounted to the aerosol container 2 such as to surround the two stems 6. The cover member 30 has an outer circumferential part 31 that surrounds the mounting cup 4. As shown in FIG. 5(*a*), the outer shape of the outer circumferential part 31 when viewed from above is a true circle. The cover member 30 has integrally formed girder portions 32, one each at opposite positions on both sides of an axial line extending from the outer circumferential part 31 in the front to back direction and orthogonal to the center axial line of the cover member 30 (coaxial with the center axial line $O_1$ of the aerosol container in this embodiment).

The girder portions 32 have an outer wall 32*a* and an inner wall 32*b* that form the outer circumferential part 31. The upper ends of the outer walls 32*a* and the upper ends of the inner walls 32*b* are joined together with a top plate 32*c*. A bridge portion 33 extends between the girder portions 32 integrally with the top plates 32*c* of the two girder portions 32. A lever 34 is integrally formed to the bridge portion 33 via a hinge $H_4$. The lever 34 can be pivoted up and down relative to the bridge portion 33 around the hinge $H_4$.

Figure 6:
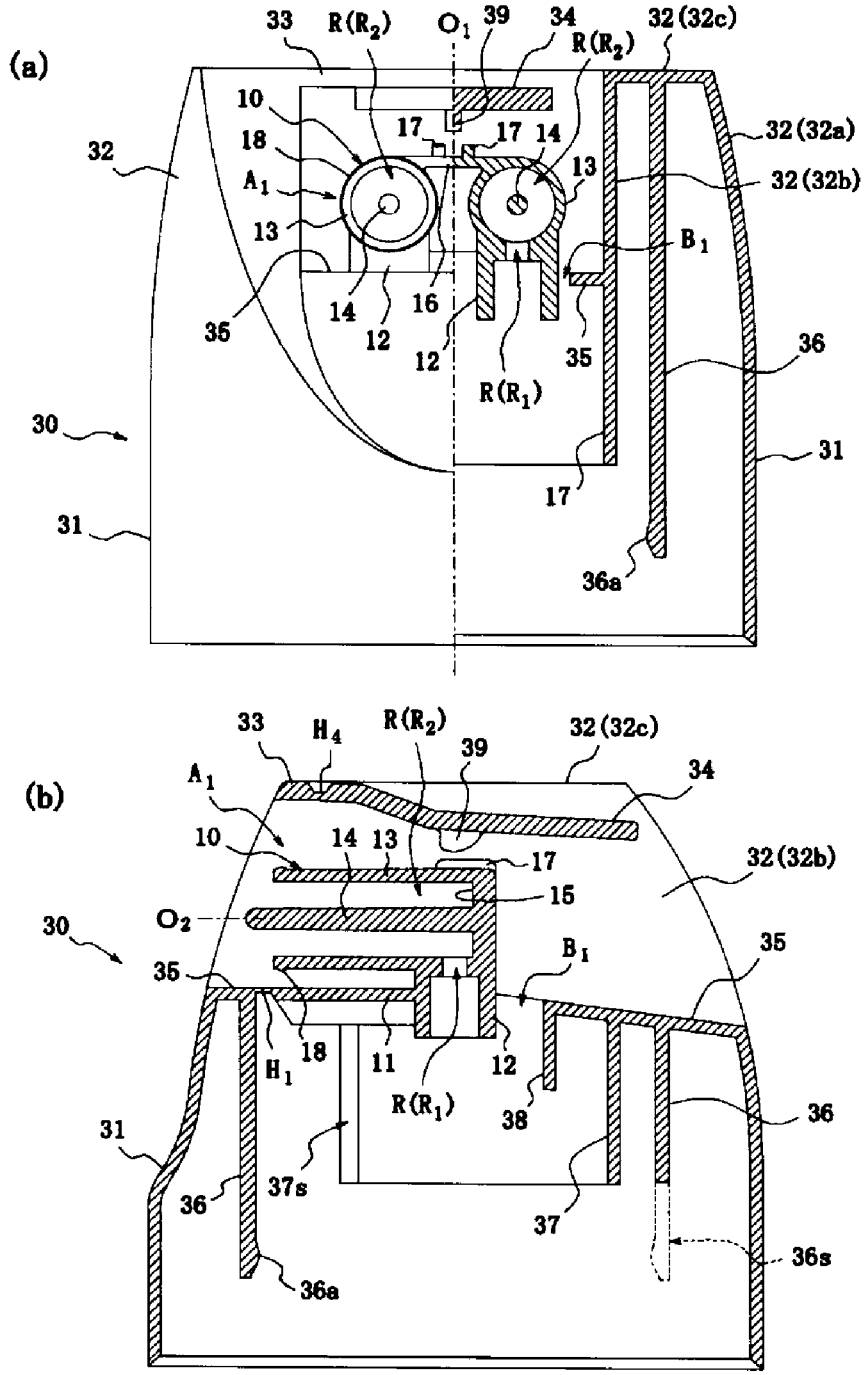
FIG. 6(*a*) is a front view schematically illustrating the cover member having the nozzle body shown in FIG. 5 in a half cross section, and (*b*) is a side view schematically illustrating the cover member in a cross section.

A shelf plate wall 35 formed with a through hole $B_1$ extends between the girder portions 32 integrally therewith. The shelf plate wall 35 is integrally connected to the lower ends of the inner walls 32*b* of the girder portions 32 as shown in FIGS. 6(*a*) and (*b*). This way, an opening $A_1$ surrounded by the girder portions 32, bridge portion 33, and shelf plate wall 35 is formed in the cover member 30. The nozzle body 10 is disposed in the opening $A_1$. In this embodiment, the nozzle body 10 is integrally formed to the shelf plate wall 35 via a hinge $H_1$.

Figure 2:
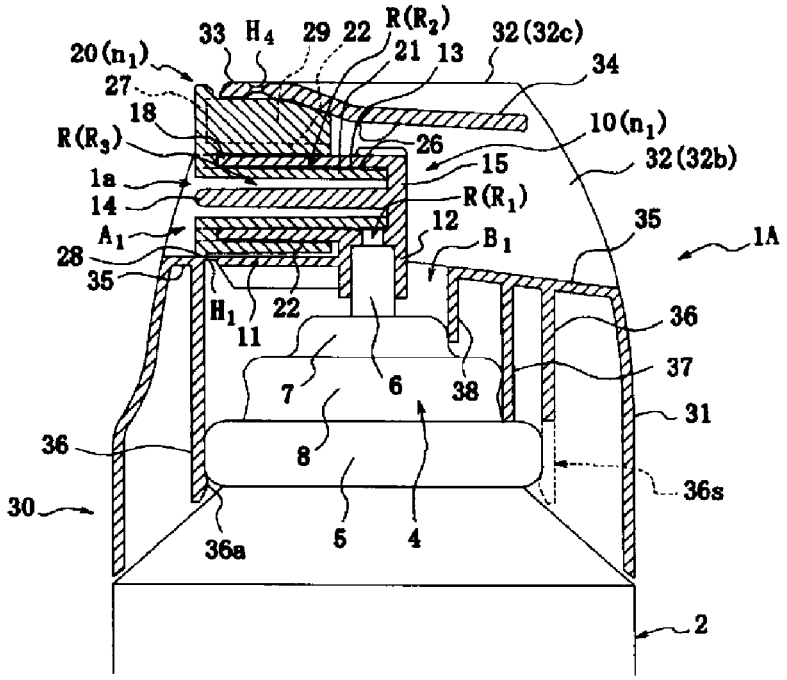
FIG. 2 illustrates the aerosol container with the dispenser shown in FIG. 1, (a) being a side view that schematically illustrates an initial state (cleaning state) of the dispenser in a cross section, and (b) being a side view that schematically illustrates an ejecting state of the dispenser in a cross section.
Figure 2:
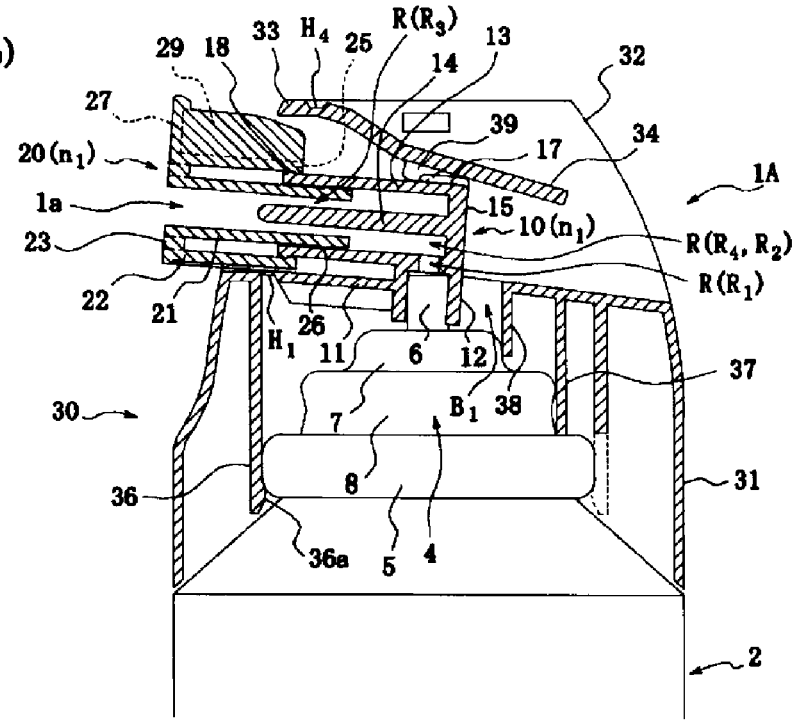

An attachment cylinder 36 is integrally formed inside the cover member 30. An engaging claw 36*a* that is to removably engage with the lower end of the annular rim 5 of the aerosol container 2 is integrally formed on the inner side at the lower end of the attachment cylinder 36. With this, the cover member 30 can be attached to and removed from the aerosol container 2 as shown in FIG. 1 and FIG. 2(*a*). In this embodiment, as shown in FIG. 2(*a*), a cut-out portion 36*s* is formed at the lower end in the back of the attachment cylinder 36 to facilitate the attachment and removal. Inside the cover member 30 is further integrally provided a support cylinder 37 that makes contact with the upper end of the annular rim 5. The support cylinder 37 ensures the engagement by the engaging claw 36*a* by making contact with the upper end of the annular rim 5. In this embodiment, as shown in FIG. 6(*b*), a cut-out portion 37*s* is formed at the lower end in the front of the support cylinder 37 to provide the pivoting path of the nozzle body 10.

In addition, a positioning wall 38 is provided inside the cover member 30. The positioning wall 38 can be contacted to one of the side faces forming the projection 7 of the aerosol container 2 that extends along the longitudinal direction, as shown in FIGS. 2(*a*) and (*b*). In this case, by rotating the cover member 30 around the center axial line $O_1$ to align the positioning wall 38 with the side face of the projection 7, the cover member 30 can be positioned circumferentially around the center axial line $O_1$ of the aerosol container 2. This way, the cover member 30 can be positioned at an appropriate circumferential position around the center axial line $O_1$ of the aerosol container 2. In this embodiment, the positioning wall 38 is integrally formed to the shelf plate wall 35. The positioning wall 38 extends downward from an edge at the back, which is one of the edges that form the through hole $B_1$.

As shown in FIG. 6(*b*), the nozzle body 10 is integrally formed to the cover member 30 via the hinge $H_1$. Therefore, the nozzle body 10 can be pivoted up and down relative to the shelf plate wall 35 of the cover member 30 around the hinge $H_1$. In this embodiment, the nozzle body 10 is provided by integrally connecting a base 11 to an edge disposed in the front, which is one of the edges that form the opening $B_1$ in the shelf plate wall 35 of the cover member 30, via the hinge $H_1$.

The nozzle body 10 includes a plurality of attachment parts 12 that are attached by removably mating with the respective stems 6, and a plurality of discharge tubes 13 extending forward from these attachment parts 12, these being disposed side by side as shown in FIG. 6(*a*). In this embodiment, a total of two attachment parts 12 are provided correspondingly to the stems 6. Therefore, a total of two discharge tubes 13 are provided as with the attachment parts 12 correspondingly to the stems 6. Inside the attachment parts 12 and discharge tubes 13 are formed passages R, one each for one stem 6. Namely, the nozzle body 10 includes two passages R formed independently of each other corresponding to the two stems 6.

The passages R are each formed by a stem-side passage $R_1$ that leads to the stem 6 as shown in FIG. 6(*b*), and an ejection-side passage $R_2$ that leads to this stem-side passage $R_1$ and extends toward the front. A center shaft 14 is provided in each of the ejection-side passages $R_2$. The center shaft 14 extends from an abutment surface 15 of the ejection-side passage $R_2$ along the axial line $O_2$ of this ejection-side passage $R_2$ (axial line of the discharge tube 13). In this embodiment, the stem-side passage $R_1$ is formed as an open hole.

The nozzle body 10 further includes a connecting wall 16 integrally formed at the upper ends of the two discharge tubes 13 to extend therebetween as shown in FIG. 6(*a*). The connecting wall 16 makes contact with a pressing piece 39 provided to the lever 34 when the lever 34 provided to the cover member 30 is pressed down. This way, the nozzle body 10 can press down the two stems 6 together into the aerosol container 2 at the same time, when the lever 34 is pressed down. In this embodiment, two ribs 17 are formed on both sides of the center axial line $O_1$ of the connecting wall 16 of the nozzle body 10. The pressing piece 39 provided to the lever 34 is disposed between the two ribs 17. This way, the nozzle body 10 can be pressed down efficiently by the lever 34 provided to the cover member 30.

Figure 7:
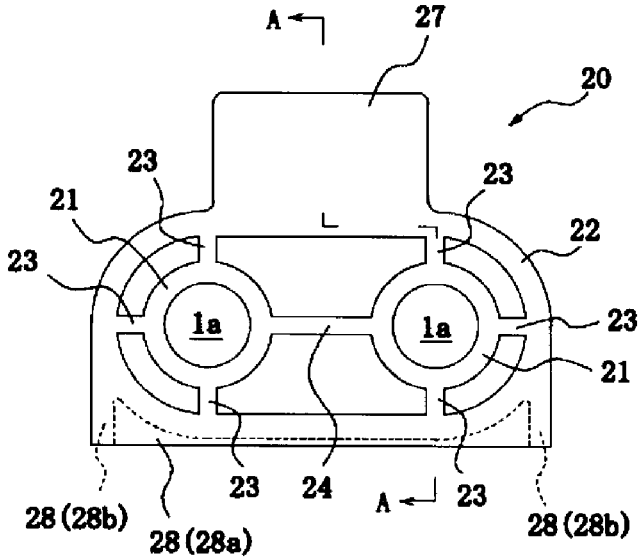
FIG. 7 illustrates a cleaning member associated with the aerosol container dispenser shown in FIG. 1, (a) being a front view that schematically illustrates the cleaning member, and (b) being a cross-sectional view along A-A of (a).
Figure 7:
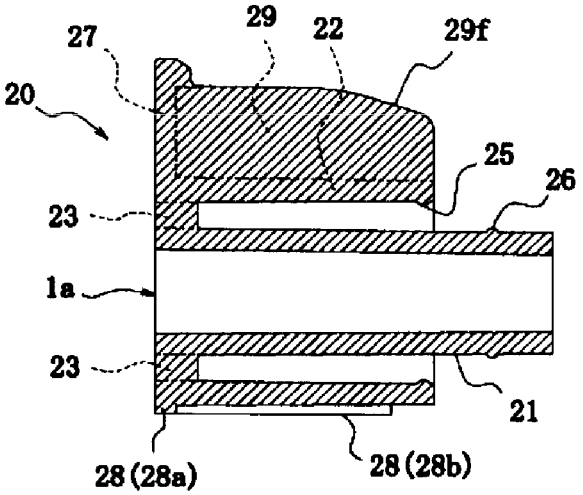
Figure 8:
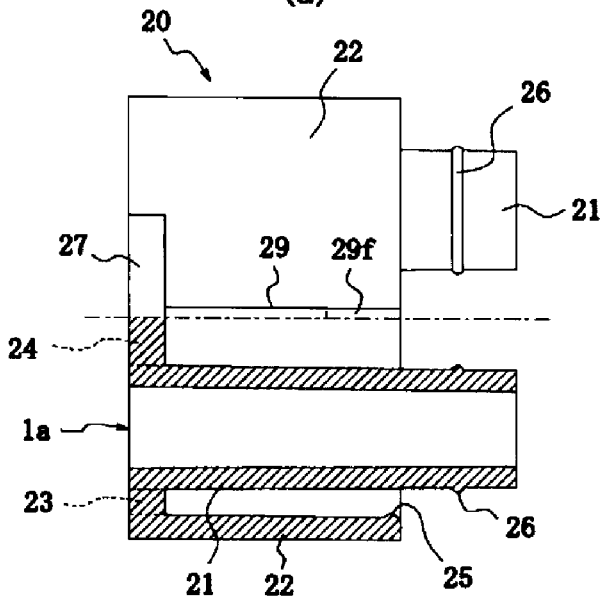
FIG. 8 illustrates the cleaning member shown in FIG. 7, (a) being a top plan view that schematically illustrates the cleaning member in a half cross section, and (b) being a side view of the cleaning member.
Figure 8:
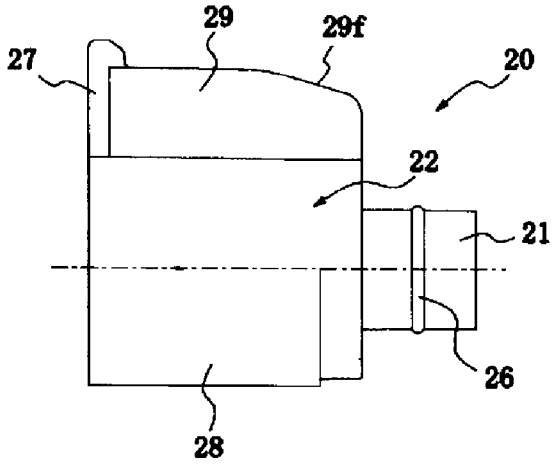

FIGS. 7(*a*) and (*b*) illustrate the cleaning member 20. The cleaning member 20 includes a total of two tubular parts 21 correspondingly to the stems 6. Inside the tubular parts 21 are formed ejection ports 1*a*, one each for one stem 6. The two tubular parts 21 are disposed side by side inside an outer tubular part 22 as shown in FIG. 7(*a*). In this embodiment, the two tubular parts 21 are each connected to the inner side of the outer tubular part 22 with three connecting pieces 23, as well as connected to each other with one connecting piece 24. The connecting pieces 23 and 24 are disposed such as to form a common plane together with the front ends of the tubular parts 21 and the front end of the outer tubular part 22, as shown in FIG. 7(*b*) and FIG. 8(*a*).

As shown in FIGS. 2(*a*) and (*b*), the outer tubular part 22 of the cleaning member 20 accommodates the two discharge tubes 13 provided to the nozzle body 10 inside, and can be slid along the direction in which the discharge tubes 13 extend. This way, the cleaning member 20 can be moved back and forth in the front to back direction relative to the nozzle body 10.

A retaining mechanism for retaining the cleaning member 20 is provided between the nozzle body 10 and the cleaning member 20. In this embodiment, as shown in FIG. 6(*a*), the discharge tubes 13 of the nozzle body 10 are each provided with an annular convex section 18 that extends along the circumferential direction of the discharge tube 13. The convex sections 18 are disposed adjacent each other at the front ends of the discharge tubes 13 as shown in FIG. 6(*b*). As shown in FIG. 7(*b*), an annular convex section 25 is provided inside the outer tubular part 22 of the cleaning member 20 such as to extend along the circumferential direction. The convex section 25 is disposed at a rear end position of the outer tubular part 22 of the cleaning member 20. Thereby, the cleaning member 20 is retained to the nozzle body 10 by the convex section 25 provided to its outer tubular part 22 making contact with the convex sections 18 provided to the discharge tubes 13 of the nozzle body 10 as shown in FIG. 2(*b*).

The tubular parts 21 of the cleaning member 20 are each slidably inserted into the ejection-side passage $R_2$ formed in the nozzle body 10, and each form, between the tubular part 21 and the center shaft 14, an annular cross section passage $R_3$ that leads to the ejection port 1*a*. The tubular parts 21 each form a space $R_4$ that connects the stem-side passage $R_1$ with the annular cross section passage $R_3$ inside the ejection-side passage $R_2$ when the cleaning member 20 is slid forward (in the direction in which the cleaning member 20 is pulled out), and this space $R_4$ can be reduced by sliding the cleaning member 20 backward (in the direction in which the cleaning member 20 is pushed in), as shown in FIG. 2(*a*).

In this embodiment, the two tubular parts 21 of the cleaning member 20 are each provided with a sealing protrusion 26 that extends along the circumferential direction of the tubular parts. The sealing protrusions 26 make sliding contact with the inner circumferential surface of the discharge tubes 13 provided to the nozzle body 10, thereby keeping a liquid tight seal between the discharge tubes 13 of the nozzle body 10 and the tubular parts 21 of the cleaning member 20 in a slidable manner. This way, the volume of the space $R_4$ can be increased as shown in FIG. 2(*b*), or decreased as shown in FIG. 2(*a*), while a liquid tight seal is maintained between the discharge tubes 13 provided to the nozzle body 10 and the tubular parts 21 provided to the cleaning member 20.

The cleaning member 20 further includes a tab 27. In this embodiment, the tab 27 is provided at the upper end of the outer tubular part 22 of the cleaning member 20. The tab 27 is formed as a plate-like portion standing upright from the upper end of the outer tubular part 22 as shown in FIG. 7(*a*). Therefore, the user can pinch the tab 27 and thereby slide the cleaning member 20 easily relative to the nozzle body 10.

In addition, the cleaning member 20 includes a nozzle lock portion 28 that prevents the nozzle body 10 from being pushed down when the cleaning member 20 is pushed into the nozzle body 10, by making contact with the shelf plate wall 35 provided to the cover member 30. In this embodiment, the nozzle lock portion 28 is provided at the lower end of the outer tubular part 22 of the cleaning member 20. The nozzle lock portion 28 is formed by a front wall 28*a* that forms a common plane together with the front end of the outer tubular part 22 of the cleaning member 20, and two side walls 28*b* extending from this front wall 28*a* toward the rear end. Namely, the nozzle lock portion 28 is formed as a leg extending from the front end to the rear end of the outer tubular part 22 of the cleaning member 20 and having a square C-shaped cross section, as shown in FIGS. 7(*a*), (*b*), and FIG. 8(*b*). The nozzle lock portion 28 prevents the nozzle body 10 from being pushed down when the cleaning member 20 is fully pushed into the nozzle body 10 as shown in FIG. 1, by making contact with part of the shelf plate wall 35 that is positioned on the girder portion 32 side of the cover member 30 more backward than the hinge $H_1$. The contact with the shelf plate wall 35 provided to the cover member 30 is released when the cleaning member 20 is pulled out more forward than the hinge $H_1$ relative to the nozzle body 10. Therefore, in an initial state or cleaning state where the cleaning member 20 is pushed in, the nozzle body 10 cannot be pushed down, while, when the cleaning member 20 is pulled out, the nozzle body 10 can be pushed down.

In addition, the cleaning member 20 includes a lever lock portion 29 that prevents the lever 34 from being pushed down when the cleaning member 20 is pushed into the nozzle body 10, by making contact with the lever 34 provided to the cover member 30, as shown in FIG. 2(*a*). In this embodiment, the lever lock portion 29 is provided at the upper end of the outer tubular part 22 of the cleaning member 20. The lever lock portion 29 is formed as a plate-like portion standing upright from the upper end of the outer tubular part 22 as shown in FIG. 7(*b*) and FIG. 8(*a*). The lever lock portion 29 extends from the back of the tab 27 to the rear end of the outer tubular part 22. In this embodiment, a slope 29*f* that conforms to the lever 34 is formed at the upper rear end of the lever lock portion 29. The lever lock portion 29 prevents the lever 34 from being pushed down when the cleaning member 20 is fully pushed into the nozzle body 10 as shown in FIG. 2(*a*), by making contact with the lever 34 provided to the cover member 30. The contact with the lever 34 provided to the cover member 30 is released when the cleaning member 20 is pulled out of the nozzle body 10, as shown in FIG. 2(*b*). This way, by pulling out the cleaning member 20, the lever 34 can be pushed down around the hinge $H_4$.

The cleaning member 20 is prevented from being further pushed in by, for example, the connecting pieces 23 and 24 of the cleaning member 20 making contact with the front ends of the discharge tubes 13 provided to the nozzle body 10, or, by the tubular parts 21 of the cleaning member 20 making contact with the abutment surface 15 provided to the nozzle body 10. In this embodiment, as shown in FIG. 2(*a*), when the cleaning member 20 is fully pushed into the nozzle body 10, part of the cleaning member 20 (front wall 28*a* of the nozzle lock portion 28) does not go further than the hinge $H_1$ but overlaps the shelf plate wall 35 provided at the front of the cover member 30.

Next, how the dispenser 1A is attached to the aerosol container 2, as well as how the liquid content C is ejected with the use of the dispenser 1A, and how residual liquid content C is removed and the nozzle $n_1$ is cleaned, will be described.

To attach the dispenser 1A to the aerosol container 2, first, the cover member 30 is attached to the mounting cup 4. Here, if the positioning wall 38 shown in FIG. 2(*a*) is aligned with the side face along the longitudinal direction of the projection 7 of the aerosol container 2, the cover member 30 will go down to a height where the lower end of the support cylinder 37 abuts on the upper end of the annular rim 5. If, however, they are misaligned with each other, the cover member will be located higher than the predetermined height because the lower end of the support cylinder 37 abuts on the upper face of the projection 7. Namely, whether they are aligned with each other or not can be determined based on the difference in height of the cover member 30, so that the assembling work is made easier. When the positioning wall and the projection are aligned with each other as the cover member 30 is rotated around the center axial line $O_1$, the cover member 30 moves down, so that the completion of positioning can also be recognized by tactile sensation. After that, by pressing the cover member 30 further, the attachment cylinder 36 deforms outward as shown in FIG. 2(*a*), thereby allowing the engaging claw 36*a* to engage with the lower end of the annular rim 5. This way, the aerosol container dispenser 1A can be positioned at an appropriate circumferential position around the center axial line $O_1$ of the aerosol container 2.

The dispenser 1A allows for ejection of the liquid content C with the cleaning member 20 being attached to the nozzle body 10, since the nozzle $n_1$ is constituted by attaching the cleaning member 20 having the ejection ports 1*a* to the nozzle body 10. The ejection ports 1*a* lead to the internal spaces of the tubular parts 21 provided to the cleaning member 20 as shown in FIG. 2(*a*). In each internal space is formed an annular cross section passage $R_3$, which leads to the ejection port 1*a*, by the center shaft 14 that extends along the ejection-side passage $R_2$ formed in the nozzle body 10. In this state, the nozzle lock portion 28 and lever lock portion 29 stop the stems 6 of the nozzle $n_1$ from being pushed into the aerosol container 2.

Figure 3:
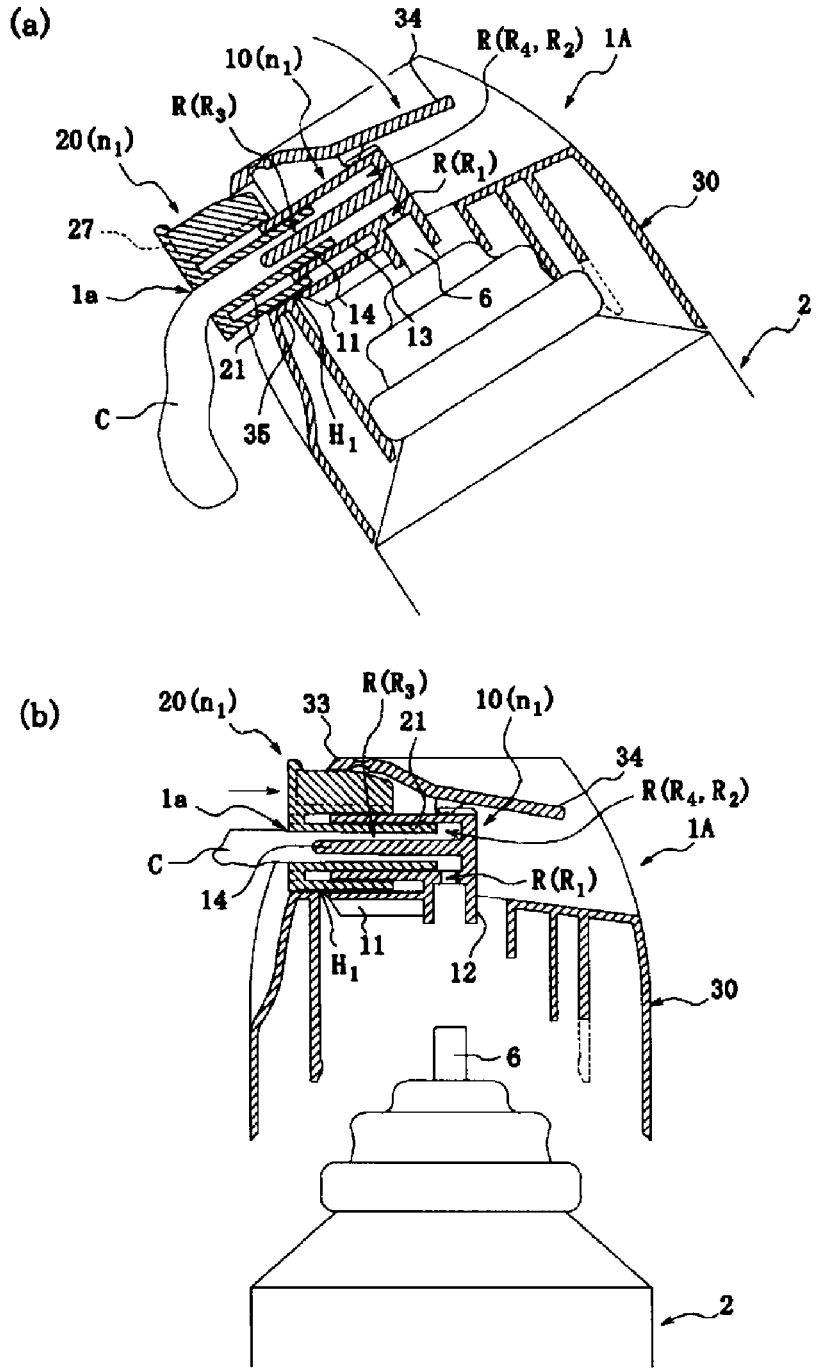
FIG. 3 illustrates the aerosol container with the dispenser shown in FIG. 1, (a) being a side view that schematically illustrates an ejecting state of the dispenser in a cross section, and (b) being a side view that schematically illustrates a cleaning state of the dispenser in a cross section.
Figure 4:
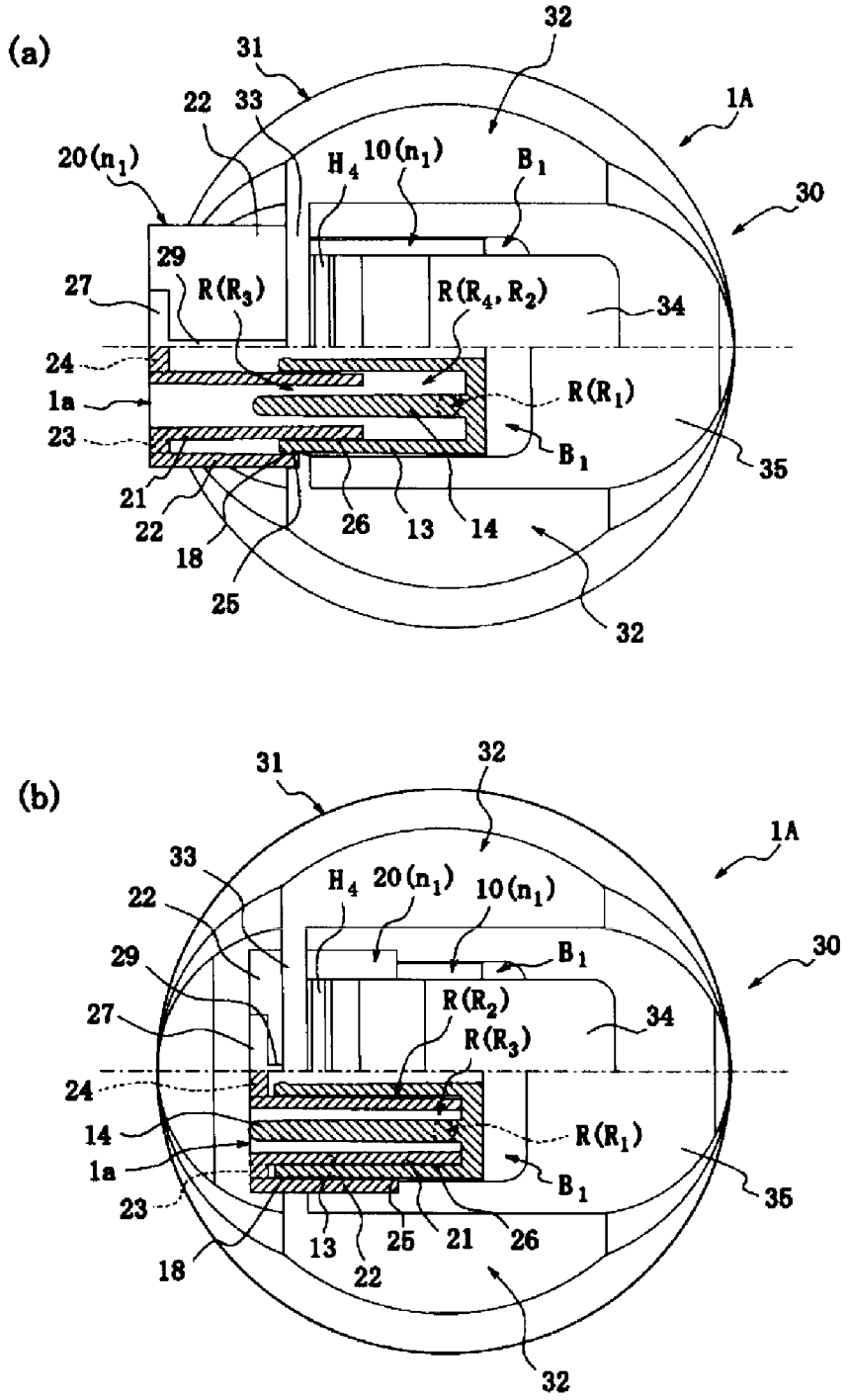
FIG. 4 illustrates the aerosol container dispenser shown in FIG. 1, (a) being a top plan view that schematically illustrates an ejecting state of the dispenser in a half cross section, and (b) being a top plan view that schematically illustrates a cleaning state of the dispenser in a half cross section.

When ejecting the liquid content C, the cleaning member 20 is pulled out of the nozzle body 10 as shown in FIG. 2(*b*), with the use of the tab 27 of the cleaning member 20. As the convex section 25 of the cleaning member 20 is caught by the convex sections 18 provided to the discharge tubes 13 of the nozzle body 10, the cleaning member 20 can be pulled out without coming off of the nozzle body 10. At this time, a space $R_4$ is formed, which connects the annular cross section passage $R_3$ and the stem-side passage $R_1$ formed in the nozzle body 10. This way, the stems 6 are brought into communication with the ejection ports 1*a* formed in the cleaning member 20 through the stem-side passages $R_1$ via the spaces $R_4$ and the annular cross section passages $R_3$. Next, the lever 34 provided to the cover member 30 is pushed down, which causes the nozzle body 10 to press down each of the two stems 6 into the aerosol container 2 together and at the same time, by means of the pressing piece 39 provided to the lever 34. This way, as shown in FIG. 3(*a*), the liquid content C inside the aerosol container 2 can be separately and independently ejected from each stem 6 through the two ejection ports 1*a* formed in the cleaning member 20. As shown in FIG. 4(*a*), the cleaning member 20 also functions as an extension nozzle by being pulled out of the nozzle body 10. It thus offers convenience of use when the liquid content C is ejected to a target object.

After ejecting the liquid content C, for cleaning, the dispenser 1A is removed from the aerosol container 2 as shown in FIG. 3(*b*). Next, the cleaning member 20 is pushed into the nozzle body 10 to reduce the spaces $R_4$, which connect the annular cross-sectional passages $R_3$ and the stem-side passages $R_1$, whereby the residual liquid content C flow reversely through the annular cross-sectional passages $R_3$ and are expelled from the ejection ports 1*a* as shown in FIG. 3(*b*). This way, the residual liquid content C can be removed without the cleaning member 20 being pulled out of the nozzle body 10.

Therefore, with the dispenser 1A, the liquid content C can be ejected with the cleaning member 20 being attached to the nozzle body 10, and the residual liquid content C can be removed and cleaning can be done without pulling out the cleaning member 20 from the nozzle body 10. Since the spaces $R_4$ are reduced to zero when the cleaning member 20 is fully pressed in, the residual liquid content C can be removed even more efficiently in this embodiment.

With the dispenser 1A of this embodiment, when the cleaning member 20 is pushed into the nozzle body 10, the nozzle lock portion 28 provided to the cleaning member 20 contacts the shelf plate wall 35 provided to the cover member 30 and prevents the nozzle body 10 from being pushed down. Therefore, even if the cleaning member 20 is accidentally pushed into the nozzle body before removing the dispenser 1A, the liquid content C is prevented from being ejected further by the nozzle body 10 being pushed down.

Similarly, with the dispenser 1A of this embodiment, when the cleaning member 20 is pushed into the nozzle body 10, the lever lock portion 29 provided to the cleaning member 20 contacts the lever 34 provided to the cover member 30 and prevents the lever 34 from being pushed down. Therefore, even if the lever 34 is accidentally pushed down before removing the dispenser 1A, the liquid content C is prevented from being ejected further by the nozzle body 10 being pushed down.

Moreover, when the cleaning member 20 is pushed into the nozzle body 10, the cleaning member 20 can be accommodated compactly relative to the cover member 30 as shown in FIG. 4(*b*). As for the cleaning method, any additional cleaning process may be performed after the operation described above, or with the operation described above, such as rinsing the dispenser 1A with water.

Hereinafter, the dispenser that has an aerosol container nozzle, which is a second embodiment of the present invention, will be described with reference to FIG. 9 to FIG. 12. In the following description, elements that are substantially the same as those in the first embodiment are given the same reference numerals and the description thereof will be omitted.

Figure 9:
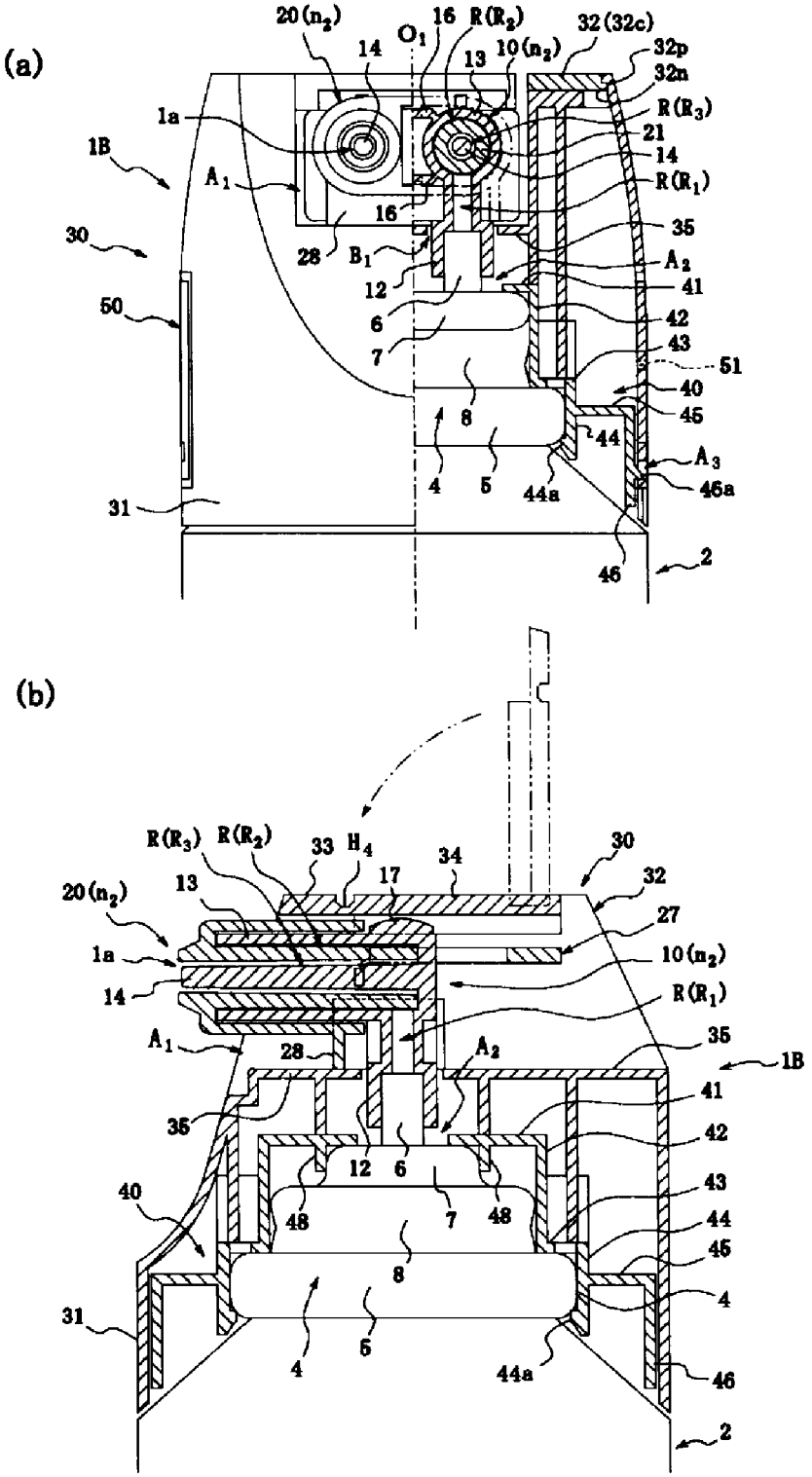
FIG. 9(*a*) is a front view of an aerosol container with an aerosol container dispenser having an aerosol container nozzle that is a second embodiment of the present invention, schematically illustrating the dispenser in a half cross section, and (*b*) is a side view schematically illustrating a developed state of the dispenser with the aerosol container in a cross section.

Similarly to the dispenser 1A, the dispenser 1B shown in FIG. 9(*a*) includes the cover member 30 and a nozzle $n_2$, the nozzle $n_2$ including a nozzle body 10 and a cleaning member 20. In this embodiment, the cover member 30 is mounted to the aerosol container 2 via a fixing plate 40 that is fixed to the mounting cup 4 of the aerosol container 2.

The fixing plate 40 includes a roof wall 41 that is in contact with the projection 7 of the aerosol container 2 except for an opening $A_2$ for exposing the two stems 6. A circumferential wall 42 integral with the roof wall 41 extends downward therefrom to surround the seat 8. An annular stepped portion 43 that covers the mounting cup 4 and makes contact with the upper end of the annular rim 5 is formed integrally around the outer rim of the circumferential wall 42. The annular stepped portion 43 is formed in an annular shape along the upper end of the annular rim 5. An attachment cylinder 44 integral with the annular stepped portion 43 extends downward therefrom to fit with the annular rim 5 of the aerosol container 2. An engaging claw 44*a* that is to removably engage with the lower end of the annular rim 5 of the aerosol container 2 is integrally formed on the inner side at the lower end of the attachment cylinder 44. With this, the fixing plate 40 is reliably fixed between the engaging claw 44*a* provided to the attachment cylinder 44 and the annular stepped portion 43.

The fixing plate 40 further includes an integrally formed annular shoulder portion 45 protruding radially outward from the attachment cylinder 44. The annular shoulder portion 45 is formed in an annular shape along the circumferential direction of the attachment cylinder 44. An outer circumferential wall 46 integral with the annular shoulder portion 45 extends downward from an outer peripheral edge of the annular shoulder portion 45. In addition, claws 46*a* are formed on both sides of the center axial line $O_1$ of the outer circumferential wall 46.

The outer circumferential part 31 of the cover member 30 accommodates the outer circumferential wall 46 of the fixing plate 40 inside and has an outer shape with substantially the same diameter as the outer circumferential surface of the aerosol container 2. Thus, the fixing plate 40 is entirely covered by the cover member 30, so that the fixing plate 40 does not need to be provided with any special decorative effect. In the outer circumferential part 31 of the cover member 30 are provided pivoting pieces 50 each formed with an engaging hole $A_3$ to engage with the claws 46*a*. The pivoting pieces 50 are connected to the outer circumferential part 31 at points along the left-right direction (orthogonal to up and down and front to back directions) by connecting pieces 51 indicated with broken lines in FIG. 9(*a*). Pressing upper regions of the pivoting pieces 50 above the connecting pieces 51 inward turns the pivoting pieces 50 around the connecting pieces 51, whereby the engaging holes $A_3$ move outward and are disengaged from the claws 46*a*. Such a fixing plate 40 allows a dispenser to be attached to the aerosol container 2 without any changes to major parts but with only partial changes to the cover member 30, so that it helps improve the development efficiency and reduce the cost.

As shown in FIG. 9(*b*), positioning walls 48 are provided inside the fixing plate 40. The positioning walls 48 make contact with those of the side faces forming the projection 7 of the aerosol container 2 that extend along the longitudinal direction. This way, the fixing plate 40 can be positioned at an appropriate circumferential position around the center axial line $O_1$ of the aerosol container 2. In this embodiment, the positioning walls 48 are integrally formed to the roof wall 41. The positioning walls 48 are provided at two points corresponding to the two side faces forming the projection 7 and extending parallel to the longitudinal direction.

Figure 10:
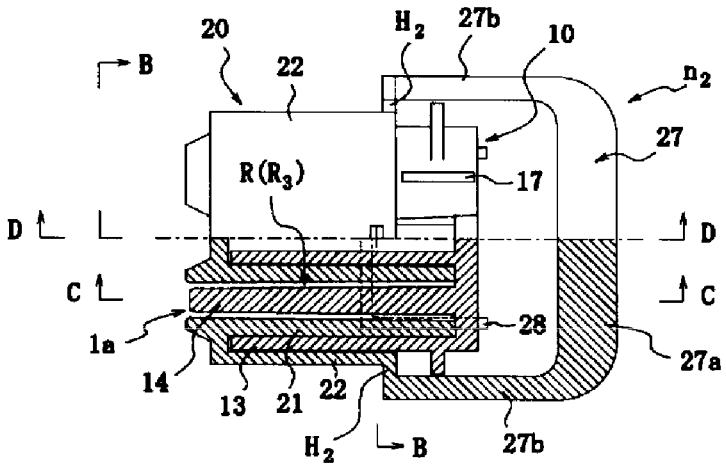
FIG. 10 illustrates a nozzle associated with the aerosol container dispenser shown in FIG. 9, (a) being a top plan view that schematically illustrates the nozzle in a half cross section, and (b) being a cross-sectional view along B-B of (a).
Figure 10:
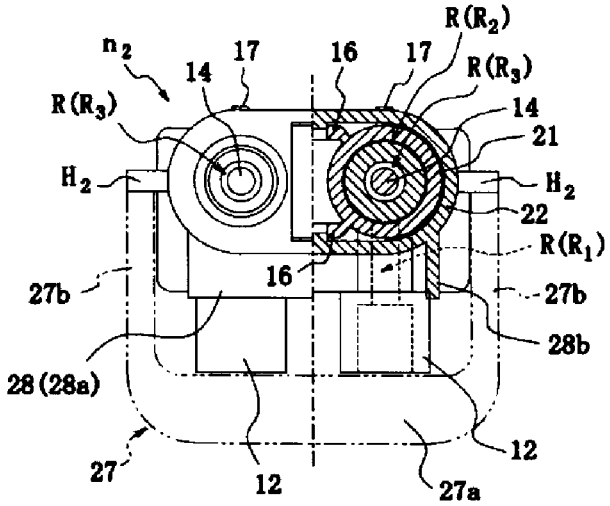

As shown in FIG. 10(*a*), the nozzle body $n_2$ has a tab 27 integrally connected to the cleaning member 20 via hinges $H_2$. Therefore, the tab 27 can be pivoted up and down around the hinges $H_2$. In this embodiment, the tab 27 includes a tab body 27*a* extending in a width direction (along which the passages R are disposed side by side), two arm portions 27*b* extending forward from both ends of the tab body 27*a*, and the two arm portions 27*b* are each integrally connected to outer side faces of the outer tubular part 22 of the cleaning member 20 via the hinges $H_2$.

Figure 11:
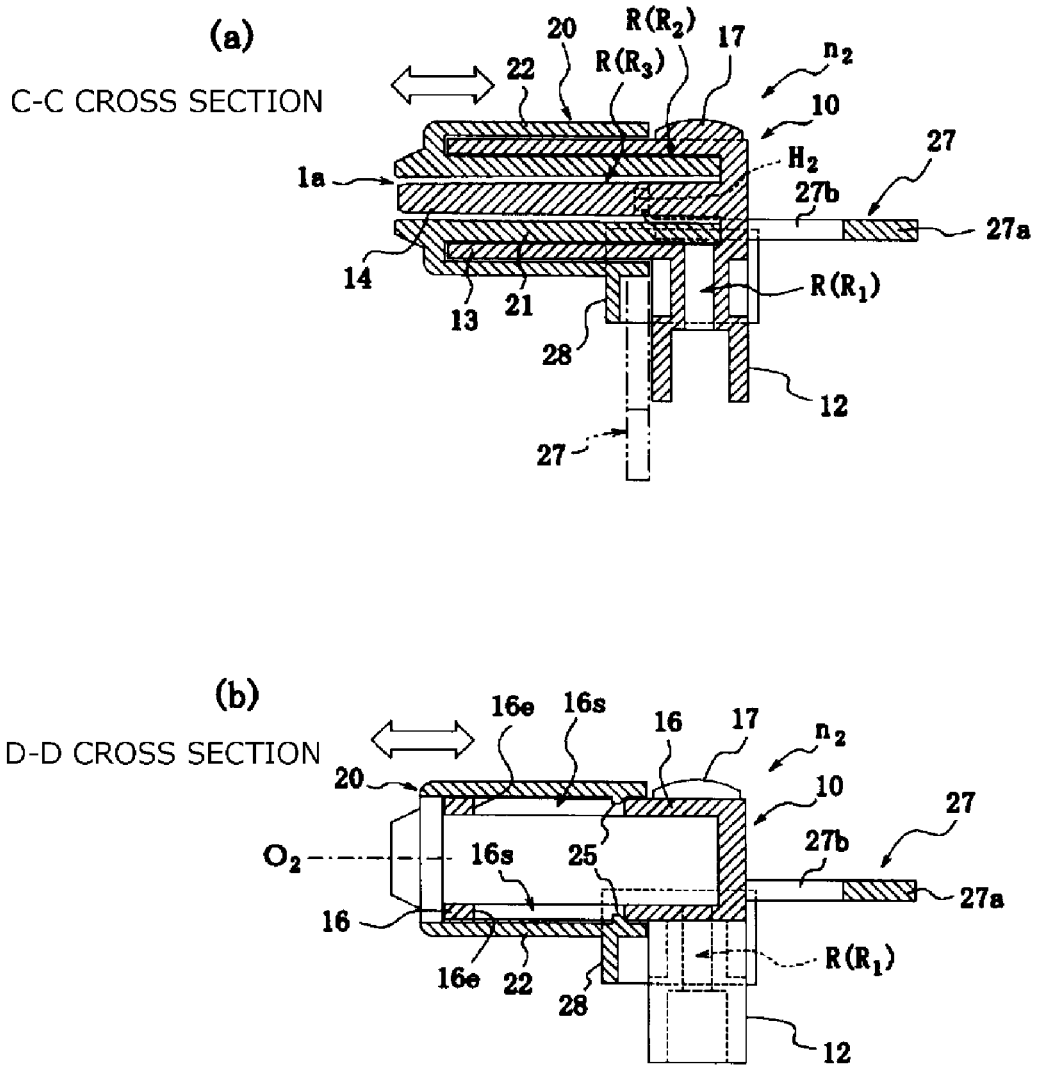
FIG. 11(*a*) is a cross-sectional view along C-C of FIG. 10(*a*), and (*b*) is a cross-sectional view along D-D of FIG. 10(*a*).

Similarly to the nozzle $n_1$, the nozzle $n_2$ includes two passages R formed independently of each other corresponding to the two stems 6, as shown in FIG. 10(*b*). In this embodiment, the stem-side passages $R_1$ are formed as a tubular passage. In this embodiment, too, as shown in FIG. 11(*a*), the tubular parts 21 of the cleaning member 20 are each slidably inserted into the ejection-side passage $R_2$ formed in the nozzle body 10, and each form, between the tubular part 21 and the center shaft 14, an annular cross section passage $R_3$ that leads to the ejection port 1*a*. The tubular parts 21 each form a space $R_4$ that connects the stem-side passage $R_1$ with the annular cross section passage $R_3$ inside the ejection-side passage $R_2$ when the cleaning member 20 is slid forward, and this space $R_4$ can be reduced by sliding the cleaning member 20 backward ("space $R_4$" not shown here).

In this embodiment, too, a retaining mechanism for retaining the cleaning member 20 is provided between the nozzle body 10 and the cleaning member 20. In this embodiment, as shown in FIG. 11(*b*), a connecting wall 16 that connects the two discharge tubes 13 with each other extends both to the upper end and to the lower end of the nozzle body 10. The connecting wall 16 has slits 16*s* each extending along the direction of the axial line $O_2$. Two convex sections 25 corresponding to the slits 16*s* are provided at upper and lower ends on the inner side of the outer tubular part 22 of the cleaning member 20. Similarly to the nozzle $n_1$, the convex sections 25 are disposed at a rear end position of the outer tubular part 22 of the cleaning member 20. Thereby, the cleaning member 20 is retained to the nozzle body 10 by the convex sections 25 provided to the outer tubular part 22 making contact with longitudinal abutment edges 16*e* of the slits 16*s* formed in the connecting wall 16 of the nozzle body 10.

Figure 12:
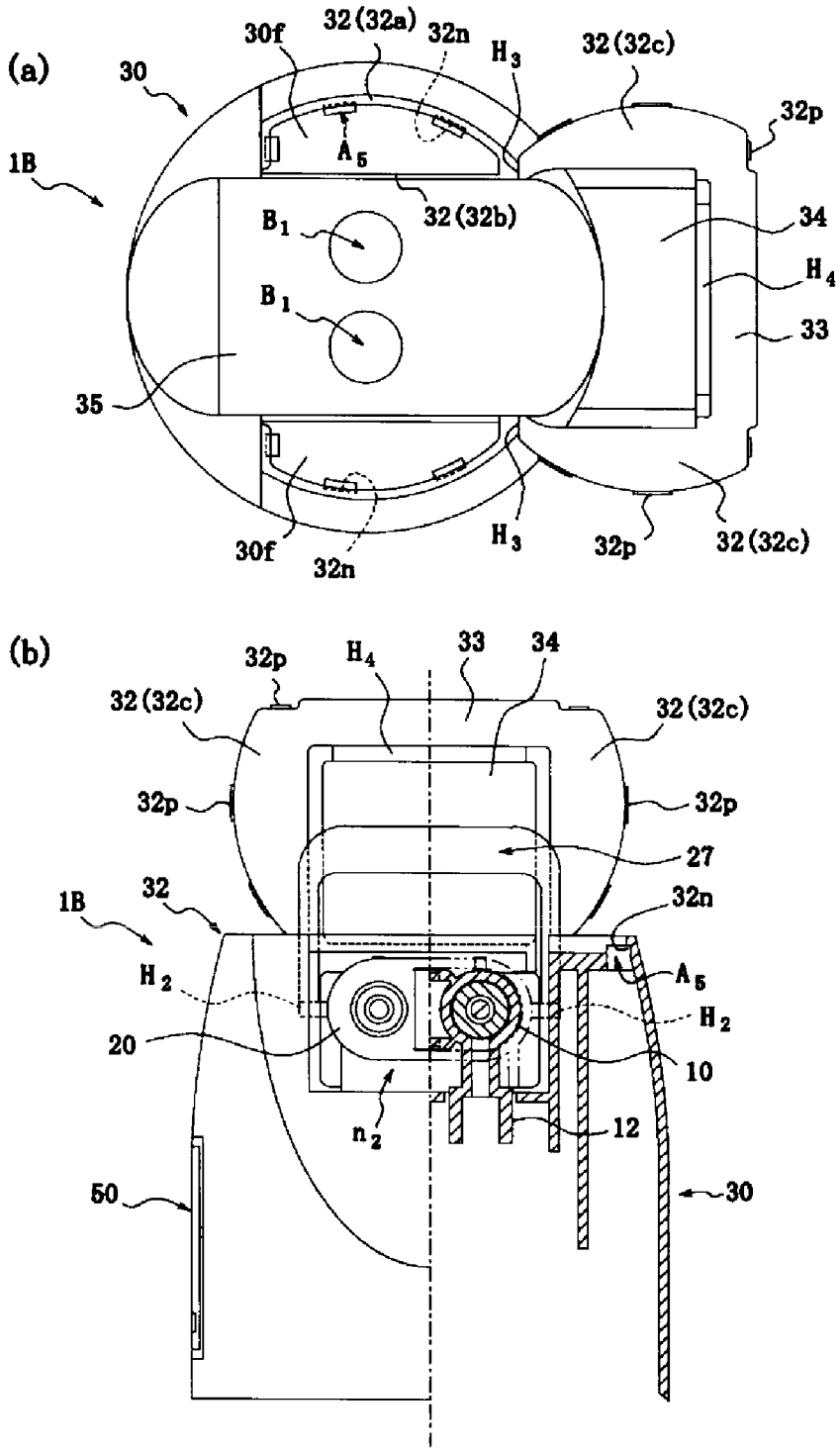
FIG. 12(*a*) is a top plan view schematically illustrating a developed state of the cover member associated with the dispenser shown in FIG. 9, and (*b*) is a front view schematically illustrating a developed state of the dispenser shown in FIG. 9 in a half cross section.

In this embodiment, as shown in FIG. 12(*a*), part of the top plates 32*c* of the two girder portions 32 of the cover member 30 are connected via hinges $H_3$ such as to be able to open and close together with the bridge portion 33. The cover member 30 is formed with mating surfaces 30*f* for forming the top plate 32*c* of the cover member 30 when part of the top plate 32*c* is turned around the hinges $H_3$ to be closed together with the bridge portion 33. Thus the top plate 32*c* of the cover member 30 is formed when part of the top plate 32*c* is closed together with the bridge portion 33. The part of the top plate 32*c* that is closed with the bridge portion 33 is provided with a plurality of engaging protrusions 32*p* along its outer edge. These engaging protrusions 32*p* engage with engaging concave sections 32*n* formed in the mating surfaces 30*f* to prevent the top plate from being pulled up. Reference numeral $A_5$ denotes a through hole for allowing the engaging protrusions 32*p* to engage with the engaging concave sections 32*n*.

Similarly to the dispenser 1A, in the initial state of the dispenser 1B in which the cleaning member 20 is pushed into the nozzle body 10, as shown in FIG. 9(*b*), the nozzle lock portion 28 is in contact with the shelf plate wall 35 of the cover member 30 so that the nozzle $n_2$ cannot be pushed down. When ejecting the liquid content C, the cleaning member 20 is pushed forward with the use of the tab 27, whereby the cleaning member 20 can be readily pulled out of the nozzle body 10. After pulling out the cleaning member 20, pushing down the lever 34 presses down the two stems 6 entirely into the aerosol container 2, as the lever 34 presses down the nozzle $n_2$ via the two ribs 17 on the nozzle body 10. This way, the liquid content C can be separately and independently ejected from each stem 6 through the two ejection ports 1*a* formed in the cleaning member 20.

After ejecting the liquid content C, for cleaning, the dispenser 1B is removed from the aerosol container 2, after which the cleaning member 20 is pulled back with the use of the tab 27. This way, the cleaning member 20 is pushed into the nozzle body 10, whereby the residual liquid content C can be removed and cleaning can be done. In this embodiment, in particular, the cleaning member 20 can be repeatedly pushed in and pulled out with the use of the tab 27, which is effective for the removal of the residual liquid content C.

Also, in this embodiment, the nozzle $n_2$ alone can be cleaned, by pulling out the nozzle $n_2$ from the through hole $B_1$ formed in the shelf plate wall 35 of the cover member 30 to separate the nozzle $n_2$ from the cover member 30.

Next, the dispenser having an aerosol container nozzle, which is a third embodiment of the present invention, will be described with reference to FIG. 13 to FIG. 15. In the following description, elements that are substantially the same as those in other embodiments are given the same reference numerals and the description thereof will be omitted.

Figure 13:
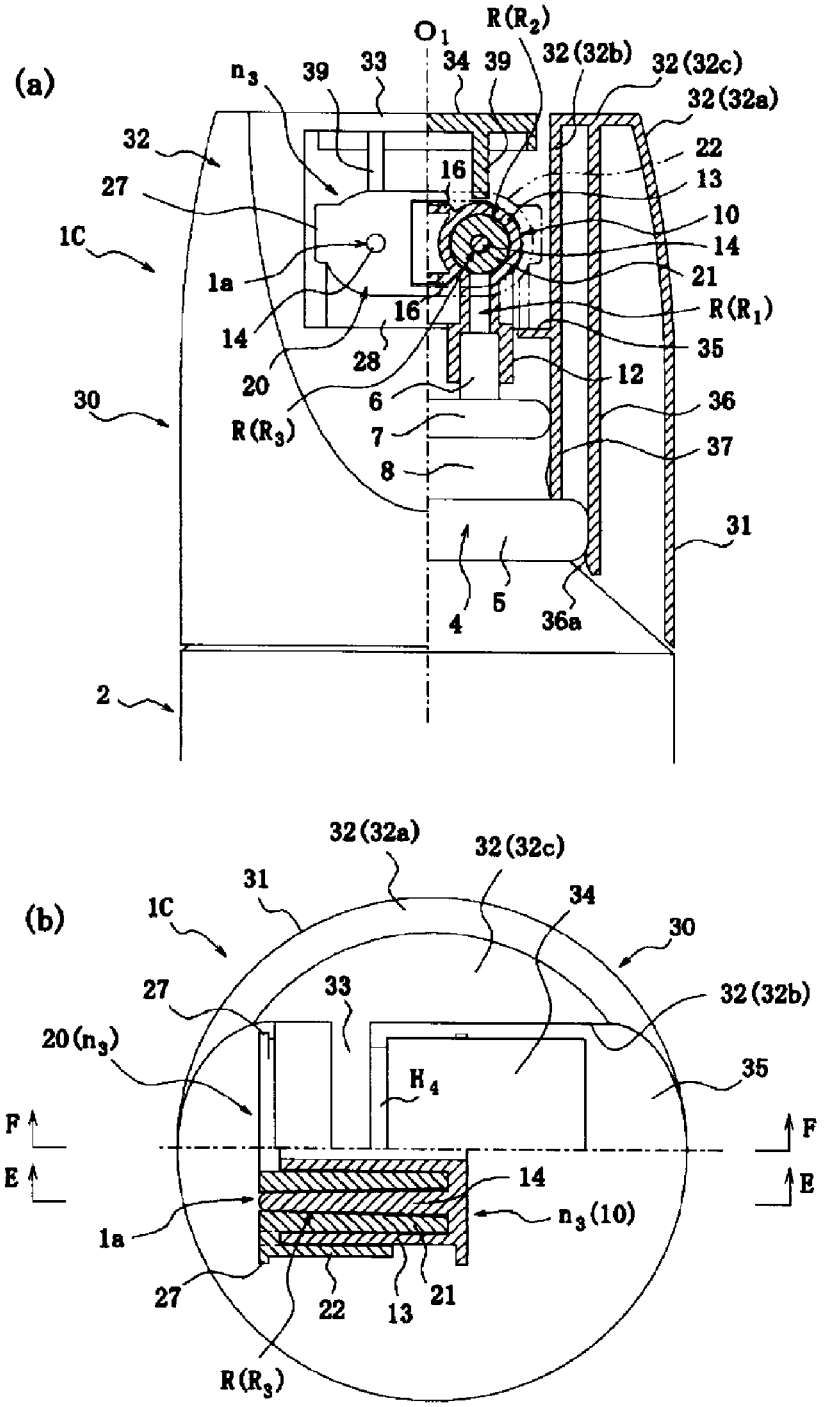
FIG. 13(*a*) is a front view of an aerosol container with an aerosol container dispenser having an aerosol container nozzle that is a third embodiment of the present invention, schematically illustrating the dispenser in a half cross section, and (*b*) is a top plan view schematically illustrating (*a*) in a half cross section.

Similarly to the other dispensers 1A and 1B, the dispenser 1C shown in FIG. 13(*a*) includes the cover member 30 and a nozzle $n_3$, the nozzle $n_3$ including a nozzle body 10 and a cleaning member 20. As shown in FIG. 13(*b*), the center shafts 14 provided in the nozzle body 10 are tapered toward the front. The tab 27 is provided on both left and right sides of the cleaning member 20. On the other hand, the inner circumferential surfaces of the tubular parts 21 of the cleaning member 20 are formed as tapered surfaces with their diameter increasing toward the back. Therefore, the annular cross section passages $R_3$ formed between the center shafts 14 provided to the nozzle body 10 and the tubular parts 21 of the cleaning member 20 reduce in diameter toward the ejection ports 1*a*.

Figure 14:
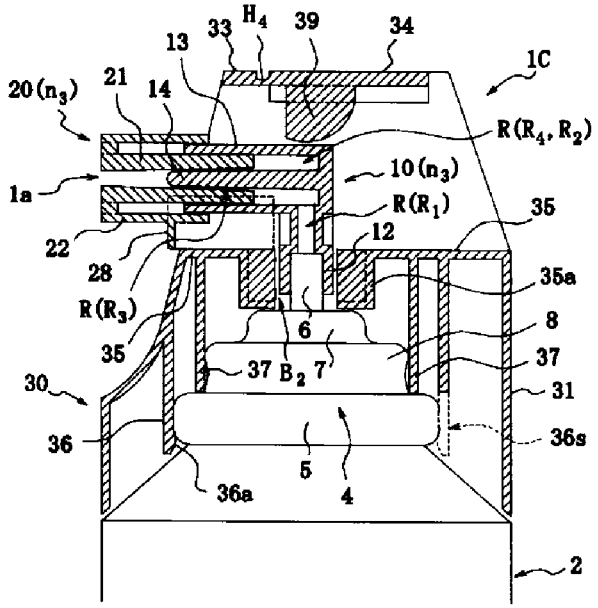
FIG. 14 illustrates the aerosol container with the dispenser shown in FIG. 13, (a) being a side view that schematically illustrates an ejecting state of the dispenser in a cross section along E-E of FIG. 13(*b*), and (b) being a side view that schematically illustrates an ejecting state of the dispenser in a cross section along F-F of FIG. 13(*b*).
Figure 14:
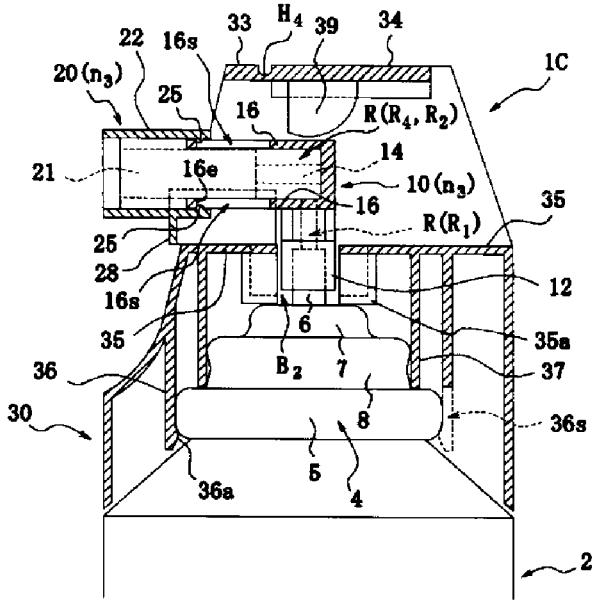

To eject the liquid content C, as shown in FIG. 14(*a*), the cleaning member 20 is pulled out of the nozzle body 10, so as to form spaces $R_4$ between the stem-side passages $R_1$ and the annular cross section passages $R_3$. When the lever 34 of the cover member 30 is pushed down around the hinge $H_4$, the pressing piece 39 of the lever 34 presses the stems 6 into the aerosol container 2 via the nozzle body 10, whereby, similarly to the other dispensers, the content liquids C can be ejected from the respective stems 6 separately and independently through the two ejection ports 1*a* formed in the cleaning member 20. The extent to which the cleaning member 20 is pulled out is limited as with the dispenser 1B, as shown in FIG. 14(*b*), since the convex sections 25 provided to the outer tubular part 22 of the cleaning member 20 make contact with the longitudinal abutment edges 16*e* of the slits 16*s* formed in the connecting wall 16 of the nozzle body 10.

Figure 15:
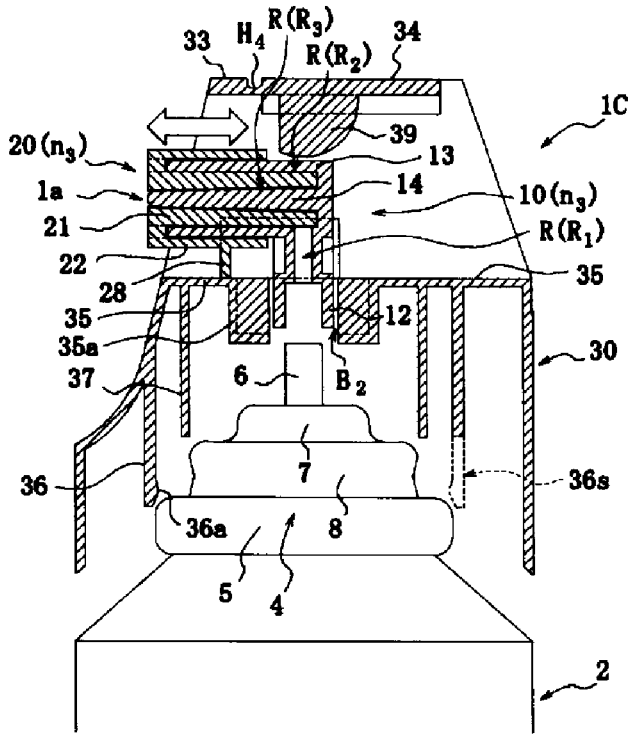
FIG. 15(*a*) is a side view schematically illustrating a cleaning state of the dispenser shown in FIG. 13 in a cross section along E-E of FIG. 13(*b*), and (*b*) is a side view schematically illustrating a cleaning state of the dispenser in a cross section along F-F of FIG. 13(*b*).
Figure 15:
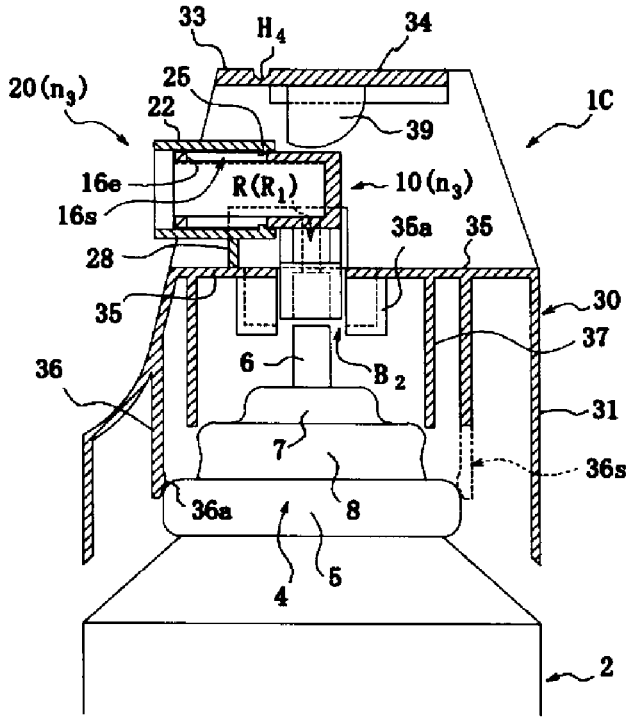

Any remaining liquid content C can be removed, by first removing the dispenser 1C from the aerosol container 2 and then pushing the cleaning member 20 into the nozzle body 10, as shown in FIG. 15(*a*). The extent to which the cleaning member 20 is pushed into is limited as with the dispenser 1B, as shown in FIG. 15(*b*). At this time, the nozzle lock portion 28 provided to the cleaning member 20 prevents the nozzle body 10 from being pushed down by making contact with the shelf plate wall 35 provided to the cover member 30. This nozzle lock portion 28 also prevents the nozzle body 10 from being unexpectedly pushed down at the initial position before and after use, similarly to the other dispensers.

The dispenser 1C is mounted by attaching the cover member 30 to the aerosol container 2, similarly to the dispenser 1A. Positioning of the cover member 30 is achieved with the upper end faces of the stems 6 instead of the positioning walls 38 that are to make contact with the side faces of the projection 7. In this embodiment, as shown in FIG. 15(*a*), an accommodation part 35*a* is provided to the shelf plate wall 35 of the cover member 30 to accommodate the two attachment parts 12 formed in the nozzle body 10, with a stem insertion hole $B_2$ formed in this accommodation part 35*a* in such a form that allows the two stems 6 to pass through together. One example of the shape of the stem insertion hole $B_2$ is a linear slot having a slightly larger width than the outer diameter of the stems 6. In this case, by rotating the cover member 30 around the center axial line $O_1$ to align the stem insertion hole $B_2$ with the two stems 6, the cover member 30 can be set in the correct position around the center axial line $O_1$ of the aerosol container 2.

While the embodiments of the present invention have been described for illustrative purposes above, various changes can be made without departing from the scope of the claims. For example, a plurality of cut-out portions may be formed at circumferentially spaced positions at the rear ends of the tubular parts 21 of the cleaning member 20. The constituent elements of various embodiments described above may be replaced with one another or combined.

INDUSTRIAL APPLICABILITY

The present invention can be adopted to an aerosol container that contains two liquid types of hair dying or hair styling products.

The invention claimed is:

1. An aerosol container nozzle, comprising a nozzle body that has a plurality of passages formed independently of each other corresponding to a plurality of stems of an aerosol container and that presses down the stems together; and a cleaning member having a plurality of ejection ports corresponding to the stems and being movable back and forth directions relative to the nozzle body, the nozzle body being removably mounted to the stems, and the passages each being formed by a stem-side passage that leads to the stem and an ejection-side passage connected to the stem-the passage and extending forward, the nozzle body having center shafts each extending inside each of the ejection-side passages from an abutment surface in the ejection-side passage along the ejection-side passage, the cleaning member having a plurality of tubular parts each slidably inserted into each of the ejection-side passages and forming, between the tubular part and each of the center shafts, an annular cross section passage leading to the ejection port, wherein the tubular parts each form a space that connects the stem-side passage with the annular cross section passage inside the ejection-side passage when the cleaning member is slid forward, and reduce the space when the cleaning member is slid backward.

2. The aerosol container nozzle according to claim 1, further comprising, between the nozzle body and the cleaning member, a retaining mechanism for retaining the cleaning member.

3. The aerosol container nozzle according to claim 1, wherein the cleaning member includes a tab.

4. The aerosol container nozzle according to claim 2, wherein the cleaning member includes a tab.

5. The aerosol container nozzle according to claim 3, wherein the tab is coupled to the cleaning member via a hinge that can pivot up and down.

6. The aerosol container nozzle according to claim 4, wherein the tab is coupled to the cleaning member via a hinge that can pivot up and down.

7. An aerosol container dispenser, comprising an aerosol container nozzle having a nozzle body that has a plurality of passages formed independently of each other corresponding to a plurality of stems of an aerosol container and that presses down the stems together; and a cleaning member having a plurality of ejection ports corresponding to the stems and being movable back and forth directions relative to the nozzle body according to any one of claims 1 to 6, and a cover member mounted to the aerosol container such as to surround the plurality of stems.

8. The aerosol container dispenser according to claim 7, wherein the cleaning member includes a nozzle lock portion that makes contact with a shelf plate wall provided to the cover member when the cleaning member is slid backward to prevent the nozzle body from being pushed down.

9. The aerosol container dispenser according to claim 7, wherein the cleaning member includes a lever lock portion that makes contact with a lever provided to the cover member when the cleaning member is slid backward to prevent the lever from being pushed down.

* * * * *